US007028965B2

(12) United States Patent
Moran

(10) Patent No.: US 7,028,965 B2
(45) Date of Patent: Apr. 18, 2006

(54) METHOD AND APPARATUS FOR RETAINING MODEL STRUCTURAL MEMBERS

(75) Inventor: Ronald D. Moran, Pittsburg, KS (US)

(73) Assignee: Pitsco, Inc., KS (US)

( * ) Notice: Subject to any disclaimer, the term of this patent is extended or adjusted under 35 U.S.C. 154(b) by 10 days.

(21) Appl. No.: 10/613,883

(22) Filed: Jul. 3, 2003

(65) Prior Publication Data

US 2005/0001130 A1 Jan. 6, 2005

(51) Int. Cl.
*A47B 91/00* (2006.01)

(52) U.S. Cl. ..... 248/346.03

(58) Field of Classification Search ..... 248/346.03; 446/1, 476, 478, 447, 108, 111, 118; 24/458; 269/400, 158, 47
See application file for complete search history.

(56) References Cited

U.S. PATENT DOCUMENTS 1,355,975 A * 10/1920 Hornby ..... 446/113
2,885,793 A * 5/1959 Oback et al. ..... 434/401
3,020,672 A * 2/1962 Zion ..... 446/120
3,067,536 A * 12/1962 Brittsan ..... 40/615
3,594,940 A * 7/1971 Yonezawa ..... 446/118
3,659,376 A * 5/1972 Fischer ..... 446/112
3,695,616 A * 10/1972 Weber ..... 273/275
4,062,130 A * 12/1977 Wood et al. ..... 434/401
4,585,422 A * 4/1986 Kay ..... 446/106
4,687,165 A * 8/1987 Blackburn ..... 248/274.1
5,318,391 A * 6/1994 Breiner ..... 408/103
5,820,436 A * 10/1998 Pohlman ..... 446/75

OTHER PUBLICATIONS

PITSCO Innovative Education 2000 Catalog, Published 2000, pp. 182-217.
PITSCO Innovative Education 2001 Catalog, Published 2001, pp. 222-251.
The PITSCO Bridge Book, Published 1989, pp. 1-22 (all).

* cited by examiner

*Primary Examiner*—Kimberly Wood
*Assistant Examiner*—Amy J. Sterling
(74) *Attorney, Agent, or Firm*—Hovey Williams LLP

(57) ABSTRACT

A method and apparatus for retaining model structural members during construction includes a base member having a plurality of recesses therein, at least one and preferably a plurality of retainers, and advantageously at least one clip having a plurality of edges and at least one arm for holding model structural members between the arm and a corresponding edge. The retainers are releasably received in the recesses and preferably include a lobe with a surface which is eccentric relative to the peg received in the recess. By turning the retainer, a biasing force may be exerted against a model structural member. The clips help to maintain the model structural members in desired orientation while bonds therebetween are cured during assembly.

23 Claims, 5 Drawing Sheets

METHOD AND APPARATUS FOR RETAINING MODEL STRUCTURAL MEMBERS

BACKGROUND OF THE INVENTION

1. Field of the Invention

The present invention concerns a method and an apparatus which holds structural members used in the construction of model buildings, towers, bridges and other structures during assembly. More particularly, it is concerned with a system which facilitates construction of three-dimensional model structures by holding the structural members in alignment during alignment, assembly and bonding by using a perforated base which removably receives retainers in recesses in the base.

2. Description of the Prior Art

Educators have found that students enjoy learning about science and technology by hands-on experience. One area where such learning techniques have enjoyed considerable success is in the construction of model structures. Allowing students to design, construct and test the performance of model structures such as buildings, towers, bridges and the like promote creativity, problem-solving, and understanding of physics and mathematics. Such structures are often constructed in the course of competitions, such as the SCIENCE OLYMPIAD® competition, which further promotes student interest and set forth design and testing parameters.

Such model structures are typically constructed from structural members which must be cut and joined together. Some of the materials used for the structural members are of wood such as balsa or basswood strips, but the model structures may also be fabricated from synthetic resin strips such as straws, and also metal rods which are joined by soldering, brazing or the like. The structural members must be measured, cut to size, and joined, and in that regard they must be held in place while glue or other adhesive is applied, or other fusing or joining in the case of synthetic resin or metal members is performed. Construction on tabletop surfaces using a person's hands to hold the materials is difficult and time consuming. One system which has been used for wood construction is a foam board where the board receives push pins which straddle the wood members to hold them in place during gluing and drying. Further, the foam boards are slidably carried in a storage carrier, such as a Pitsco™ Construction Caddy™, whereby the foam board may be removed while the glue dries and another foam board is substituted.

The model structural members, and the resulting structures, are somewhat fragile. As opposed to full sized construction, even modest applications of force by hand are sufficient to snap or bend many structural members. Thus, a system used for holding the components in position should avoid penetration of the members which further weakens them, and the use of large clamps or vises as are typically used in construction of full-sized structures is entirely unsuitable for use in the rather delicate model structures. However, there has arisen a need for an improved system for holding structural members of model structures during construction which promotes greater consistency in construction and design without the application of excess forces such as those applied by most vises and clamps.

SUMMARY OF THE INVENTION

This need has largely been met by the method and apparatus for retaining model structural members of the present invention. Substantial advantages afforded by the present invention include the provision of a base member which assists in visually aligning the members prior to assembly, which provides compressive force to the members during assembly notwithstanding slight deviations in the cut length of the member, which permits assembly of an entire model structure in three dimensions without the necessity of removing and remounting the model structure to the base member, which holds members at predetermined angles for uniformity and consistency in construction, and provides substantial flexibility in regard to the type of structure to be constructed, permitting curved as well as linear members to be employed while still providing compressive strength. In the case of wooden structural members which must be soaked in water to permit bending, the present invention enables the wooden members to be readily retained in their desired curvature during drying without yielding to the resilient force of the bended wood, thereby helping to ensure that the completed structure retains the desired configuration.

Broadly speaking, the present invention includes several components which, when integrated, greatly facilitate the construction of model structures. The components include a perforated base member having a plurality of commonly sized recesses which are preferably spaced at regular intervals to removably receive retainers therein. The retainers include a peg preferably sized for snug receipt into a selected recess and a flange normally positioned upwardly from the peg for clamping a structural member onto the base member. Preferably, at least one lobe for abutting the structural member is positioned between the peg and the flange and includes an engagement surface eccentrically positioned in relation to the peg such that the distance between the peg and the engagement surface varies depending upon a position on the engagement surface. The peg defines a pivot axis whereby upon rotation of the retainer, the engagement surface may be brought into engagement with the structural member and apply a variable biasing force thereagainst depending on the amount of turning of the retainer. This biasing force assists in the adhesion and alignment of the structural members during assembly.

In addition, the present invention includes at least one clip which provides edges at predetermined angles and retaining arms sized complemental to the structural members for holding the structural members against the edges. The edges may be configured to be linear or arcuate, as desired. For example, a clip may be triangular with two 45° corners and a 90° corner to hold three structural members, or triangular with a 30° corner, a 60° corner, and a 90° corner. Students constructing different models may thereby experiment and compare in regard to which presents the strongest structure with the structural members aligned as designed, rather than at a substantial variance from the design angles. Such clips may, alternatively, have an arcuate surface as might be used, for example, in a chord of an arch bridge, with the curvature of the structural member being conformable along the edge of an arcuate portion of the clip. These components work in complementary relationship to one another, whereby multiple retainers and clips can be used on structural members and assembled on the base member, with the snug fitting relationship of the peg of the retainer and the recess in the base serving to both hold down the structural member and also maintain a biasing force by the retainer laterally against the structural member. Further, the provision of the clips permits a structure to be assembled and bonded in three dimensions, as the clips hold the members together not only on the base member but also during drying and when turned or elevated above the base member. While the base member most preferably has all of the recesses at regularly spaced intervals in essentially a grid-like pattern in order to facilitate measurement and alignment, it is to be understood that some recesses may also be provided at irregularly spaced intervals in order to provide additional flexibility in regard to design and construction of the structures. However, the eccentric relationship between the peg and the engagment member's eccentric surface not only accommodates slight deviations in the cut structural members, but also provides flexibility in regard to positioning the structural members at irregular angles or intervals with respect to the spacing of the recesses.

The present invention is preferably constructed of synthetic resin components as described above for use with wooden or synthetic resin structural members. Beneficially, the synthetic resin retainers However, the components can also be of metal or other heat resistant materials which exhibit resiliency in the event that it is desired for use in holding metal structural members which are soldered or brazed together.

The method of the present invention differs from the conventional method of using pins which pierce foam board in that the structural members are firmly held in position on the base member. The method broadly includes the steps of providing a base member with a plurality of recesses at regularly spaced intervals and a plurality of retainers having pegs complementally sized with the recesses for movable and removable receipt in the recesses, positioning at least one and preferably a plurality of model structural members on the base member, and holding the at least one model structural member on the base member by inserting the peg into a recess with the flange in clamping engagement with the structural member. Preferably, the method includes holding a plurality of structural members in engagement with one another by respective retainers. More preferably, the method includes providing retainers with lobes which by virtue of the eccentric relationship between the peg and their engagement surfaces, such that by turning the retainer around the peg, the engagement surface is brought into engagement with the structural member. Most preferably thereby applying a biasing force to push two adjacent structural members together during bonding. Other aspects of the method include employing clips with preselected angular edges and holding the structural members along the edges of the clips by resilient arms, rotating the structure on the base member to add additional structural components thereto, and employing the retainers to hold the structural members in arcuate, substantially non-linear relationships.

As a result, the present invention provides a gentle, yet firm system for holding model structural members in position during assembly, and retains them in the desired position during curing or solidification of the bonding material not only when the parts are lying flat against the base member, but also permits continued assembly even when some of the joints between structural members are not fully cured. The present invention is useful in connection with a range of different materials for model structures and greatly facilitates alignment of the structural members during assembly. Further benefits and features of the invention hereof will be readily appreciated by those skilled in the art with reference to the attached drawings and the detailed description of the preferred embodiment which follows.

DESCRIPTION OF THE PREFERRED EMBODIMENT

Figure 1:
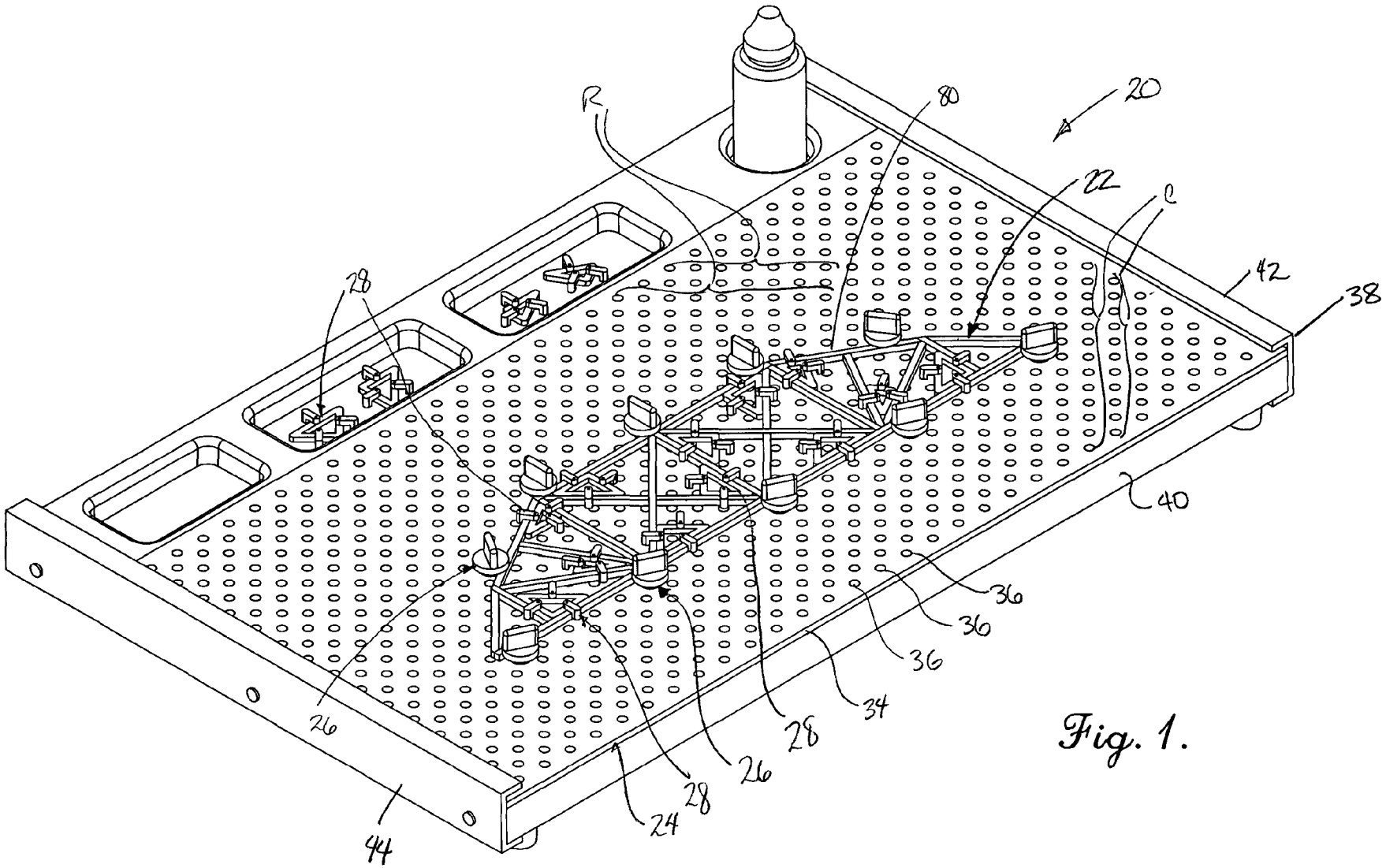
FIG. 1 is a perspective view of the apparatus of the present invention, showing a plurality of model structural members on the base member and held in place by retainers and clips.

Referring now to the drawings, an apparatus 20 for retaining model structural members 22 broadly includes a base member 24 and retainers 26 removably mounted thereto. In addition, the apparatus 20 may also include clips 28 for removably coupling to the model structural members 22 for retaining the model structural members 22 in a desired orientation during bonding whereby, upon curing, the completed model structure 30 such as the model bridge 32 shown in FIG. 10 may be constructed. As used herein, the terms "model structural members" are to be understood as small components of wood, synthetic resin, metal or the like which are intended to be combined and bonded together by adhesive, solvent bonding, soldering, brazing or welding, although other methods of attachment may be used. "Model structures" are reduced scale models of structures such as bridges, towers, buildings and the like and are to be contrasted with their full-scale counterparts. Such model structures are useful for educational purposes to instruct students in design and assembly techniques and for teaching scientific and engineering principles, the assembled model structures then often being tested as a part of student competitions for their integrity and ability to support loads.

Figure 2:
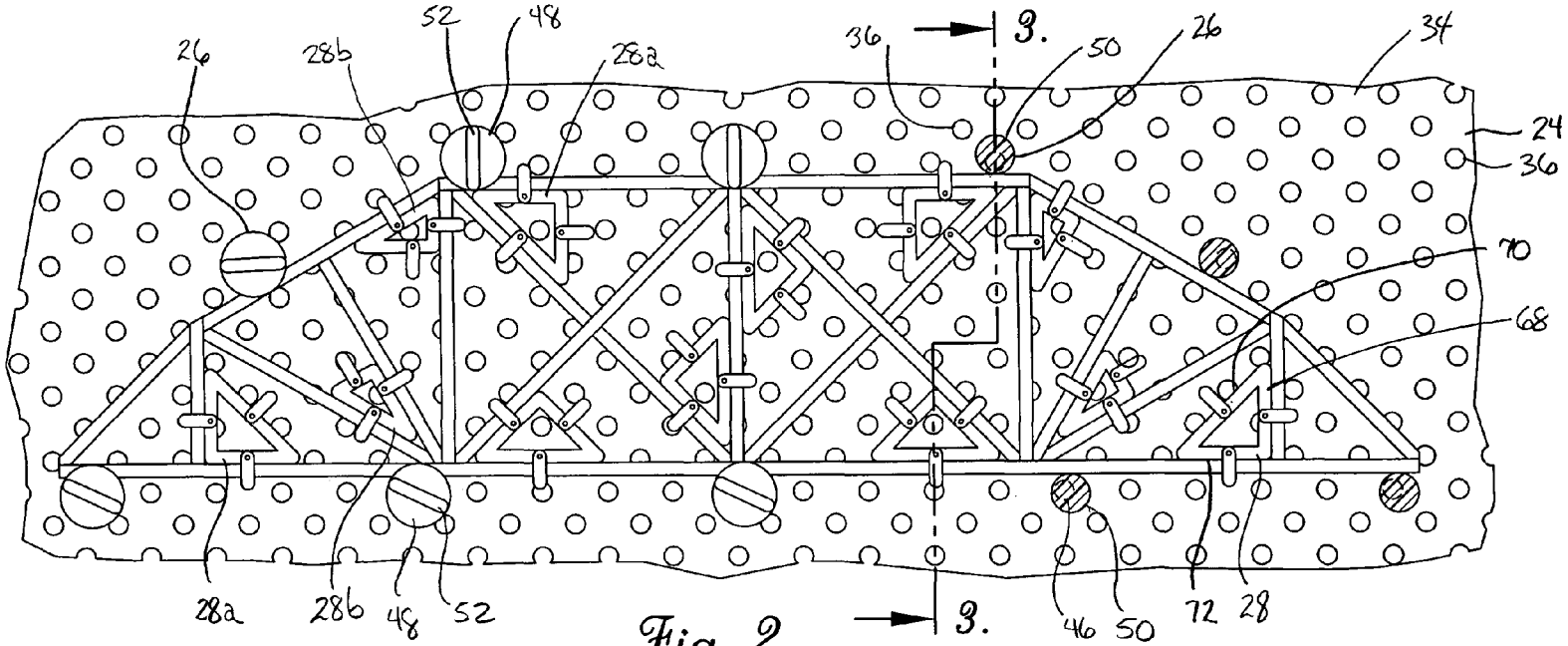
FIG. 2 is an enlarged fragmentary top plan view of the apparatus hereof showing a portion of the base member with some of the retainers shown in horizontal cross-section with the flange broken away to show the lobe of the retainer having an engagement member in abutment with structural members and broken lines showing the peg positioned in a recess of the base member and eccentrically positioned relative to the lobe.
Figure 3:
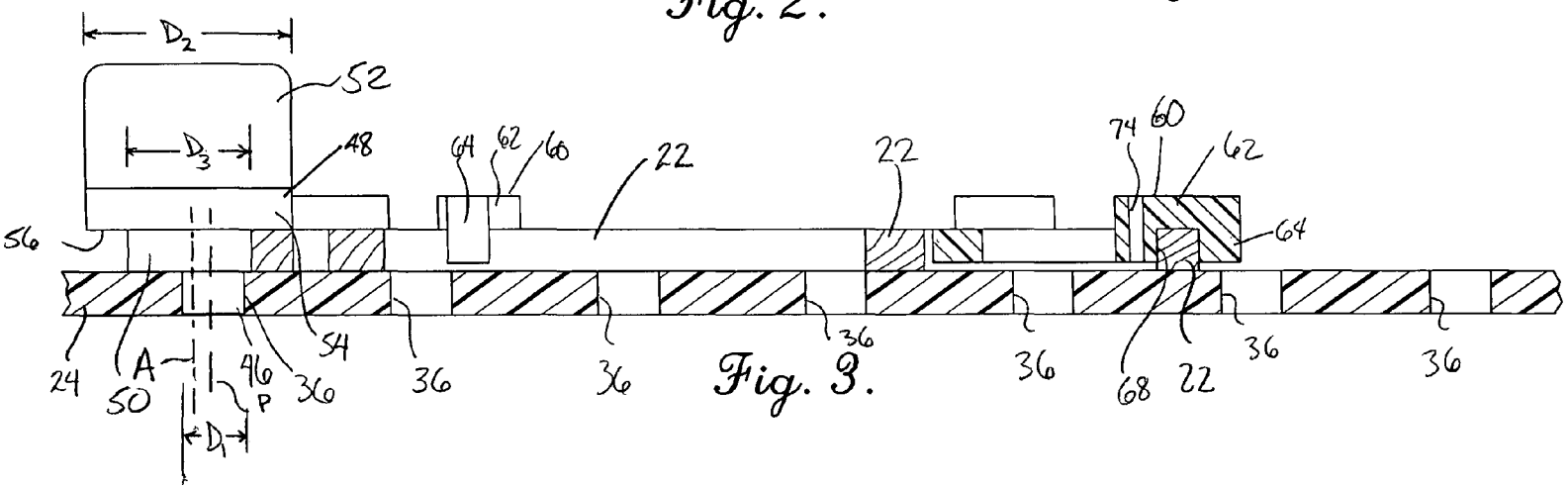
FIG. 3 is a fragmentary vertical cross-sectional view taken along line 3—3 of FIG. 2 to show the positioning of two of the clips and one of the retainers against the model structural members with one of the retainers shown in elevation for clarity.
Figure 9:
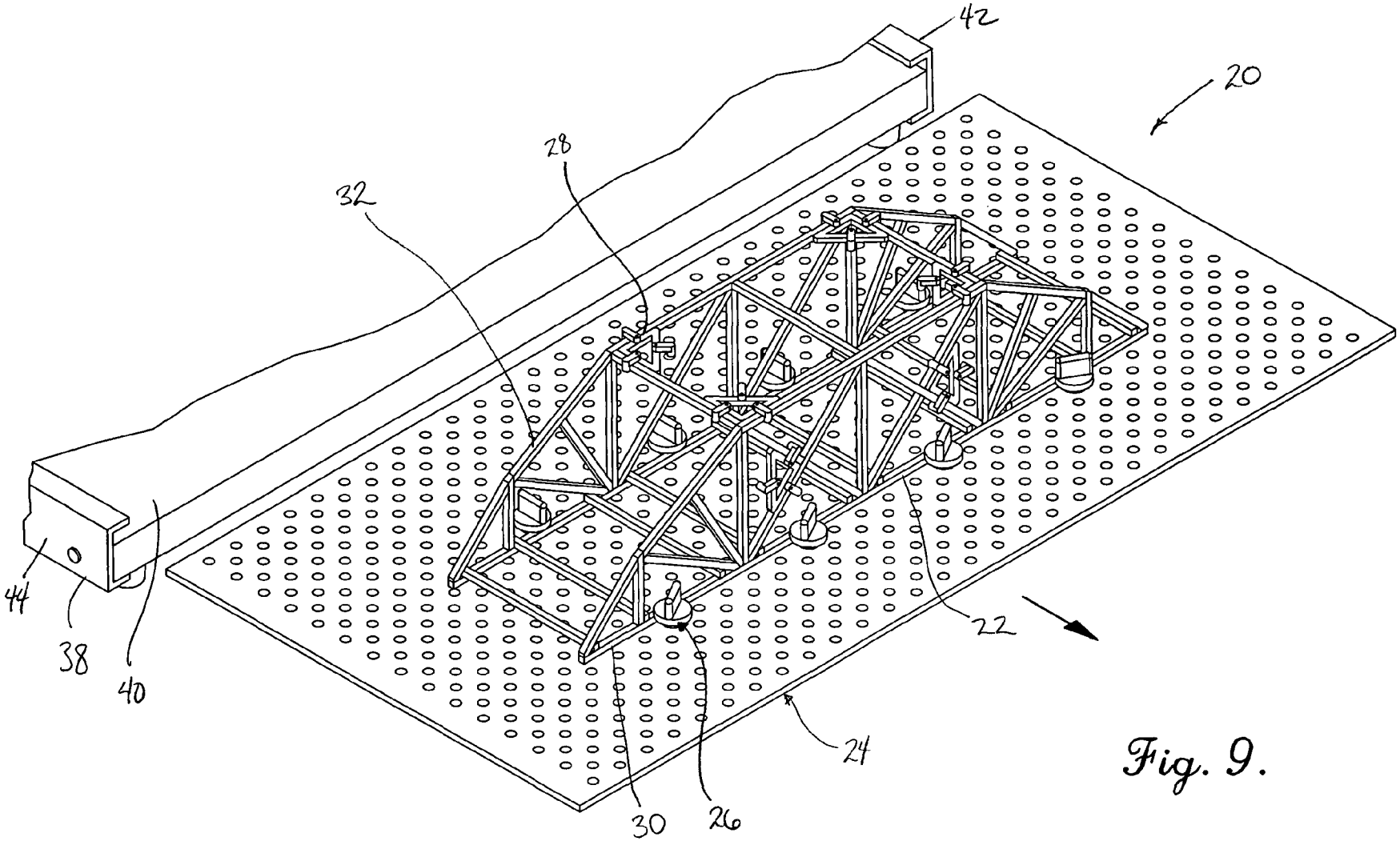
FIG. 9 is a perspective view of a model structure held by retainers on the base member and with some clips used for holding the structural members above the base member, the base member being removed from the carrier.
Figure 10:
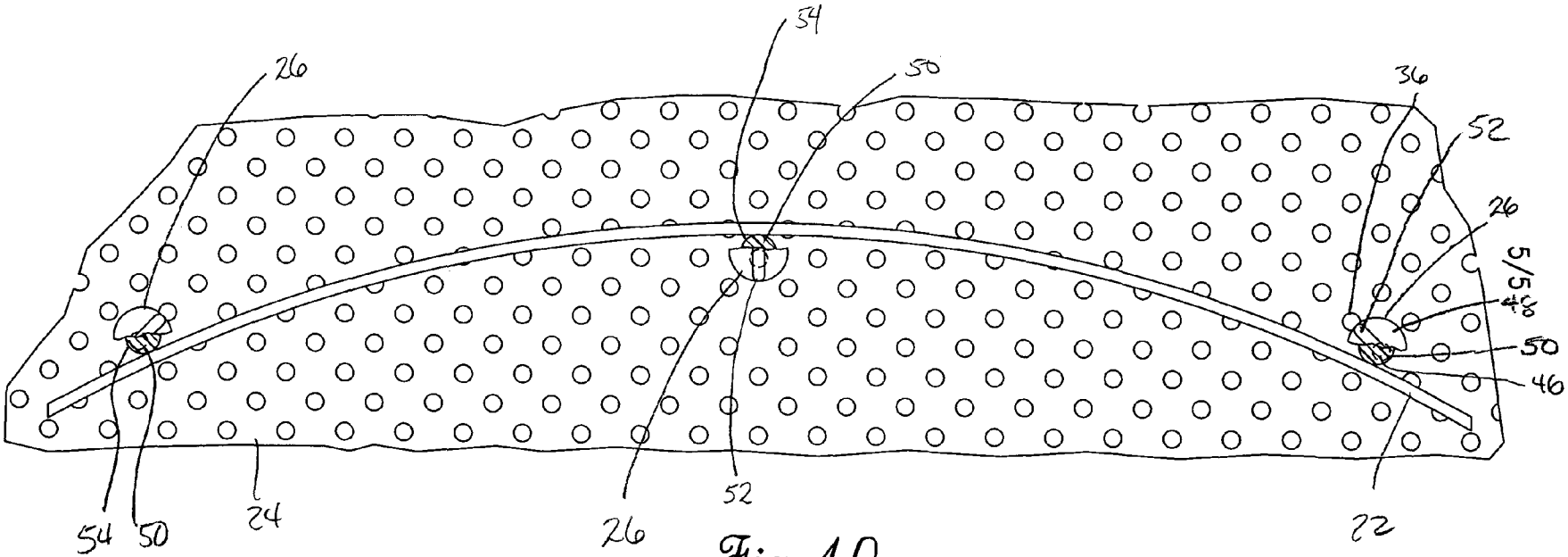
FIG. 10 is a fragmentary top plan view of the apparatus hereof showing the use of the base member and three retainer for holding a model structural member in an arcuate configuration.

In greater detail, the base member 24 is preferably a perforated planar member 34 and having a plurality of recesses 36. Most preferably, the recesses 36 are holes extending through the thickness of the planar member 34 as illustrated in FIG. 3 and which are circular in cross section as illustrated in FIG. 2. The recesses 36 are preferably arrayed in columns C and rows R in regular spacing, whereby consistent interval spacing between the recesses 36 is substantially maintained across the base member 24. This facilitates measurement and placement of the model structural members 22 during design, cutting and assembly, and also positioning of the retainers 26 mounted to the base member 24. One benefit of such regular spacing is that the user may readily visually ascertain the spacing between retainers 26 on the base member and thereby more easily determine whether the model structure under construction matches the intended design, such as by obtaining a desired arcuate shape as shown in FIG. 10. The base member 24 is preferably provided as a single sheet of synthetic resin, such as high density polyethylene, nylon, Teflon or Delrin which resists adhesion to bonding agents and thus facilitates cleaning for reuse. However, other materials may be used for the base member, such as steel when soldering, brazing or the like is used to bond together model structural members 22 of metal. Advantageously, the base member 24 may be removably mounted into a carrier 38 as shown in FIG. 1. The carrier 38 preferably includes a floor 40 and a pair of spaced apart side rails 42 and 44 each of which include a lip 46 positioned above the floor 40. The base member 24 may thus be supported by the floor and held between the side rails 42 and 44 during assembly, and then removed from the carrier 38 while the bonding of the structural members 22 is permitted to cure, as shown in FIG. 9. This allows one carrier 38 to sequentially support a plurality of base members 24 during such curing. The carrier 38 may include wells for holding spare retainers 26, clips 28, extra model structural members 22, or bottles of adhesive as shown in FIG. 1.

Figure 4:
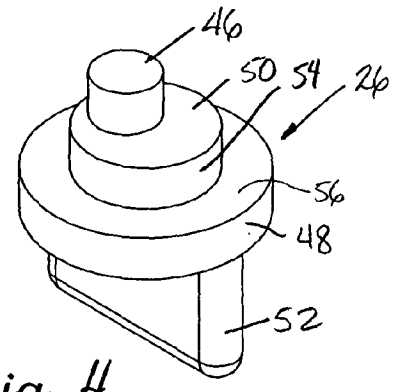
FIG. 4 is an enlarged inverted perspective view of a retainer to show the peg which is eccentrically positioned relative to the surface of the lobe for abutting the structural member.

The retainers 26 are shown in detail in FIGS. 3 and 4 and include a peg 46, a flange 48, a lobe 50 positioned between the flange and the peg, and a handle 52. The peg 46 is circular in cross-section having a first transverse dimension $D_1$ and sized complementally to the recesses 36 of the base member 24 such that the pegs 46 snugly fit within the recesses 36. The pegs are preferably sized such that a friction fit is obtained between the peg 46 and the base member surrounding the recess 36 into which the peg is received. The peg 46 resists turning within the recess by the friction fit, but this friction fit may be overcome by the user whereby by grasping the handle 52, the user may twist the retainer 26 so that the peg 46 pivots or rotatably shifts within the recess 36 about a pivot axis P. The lobe 50 has a circumferentially extending engagement surface 54, the lobe being larger in cross-sectional area than the peg 46 to resist entry into the recess 36 as shown in FIG. 2. The relative positioning of the peg and the lobe 50 and the configuration of the engagement surface 54 is such that the engagement surface 54 is eccentrically positioned relative to the peg 46. This may be accomplished, for example, by providing the lobe 50 of a shape such that the engagement surface 54 is circular with the peg 46 positioned offset to the center axis A of the circle as shown in FIGS. 2, 3 and 4. Alternatively, the lobe 50 may be oval, cam shaped or of another non-circular shape and the peg 40 positioned in alignment with the center of the flange 48. In either alternative, turning the retainer 26 within the recess 36 causes the engagement surface 54 to move toward or away from an adjacent structural member to thereby vary the biasing force applied to the structural member 22 by virtue of the offset relationship between the peg 46 and the engagement surface 54. The engagement surface 54 is preferably of a height (the dimension between the peg and the flange) substantially the same as the thickness of the model structural members 22 to be held. The flange 48 has a second transverse dimension $D_2$ which is larger than the transverse dimension $D_1$ of peg 46 or a transverse dimension $D_3$ of lobe 50 ($D_1<D_3<D_2$) and thus has holding surface 56 on its underside opposite the handle 52 which is radially outward of the engagement surface 54. Because the height of the engagement surface 54 is substantially the same as the thickness of the model structural members 22, the holding surface 56 abuts the model structural members 22 and the holding surface 56 helps to hold the model structural members 22 down onto the base member 22 due to the friction fit of the peg 46 in the recess 36. While the retainers 26 may be manufactured of a variety of different materials such as ceramics or metal, most advantageously they are unitary and molded of synthetic resin material such polyethylene which is both inexpensive and durable and provides a good frictional fit with the base member 24. In addition, the retainers may be molded of different colors for aiding the user in placement, for differentiating between the projects of different students, or for color coding for size if it is desired that retainers having different sized flanges be used.

Figure 6:
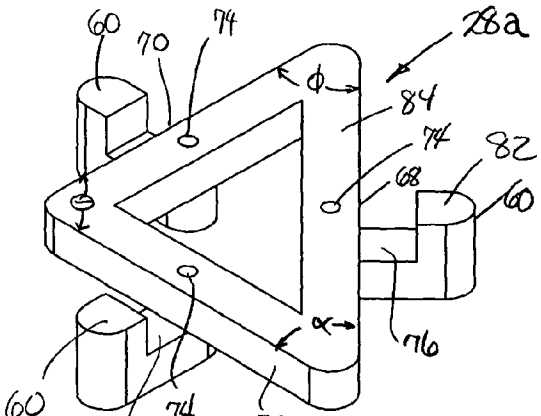
FIG. 6 is an inverted perspective view of the clip of FIG. 5.
Figure 5:
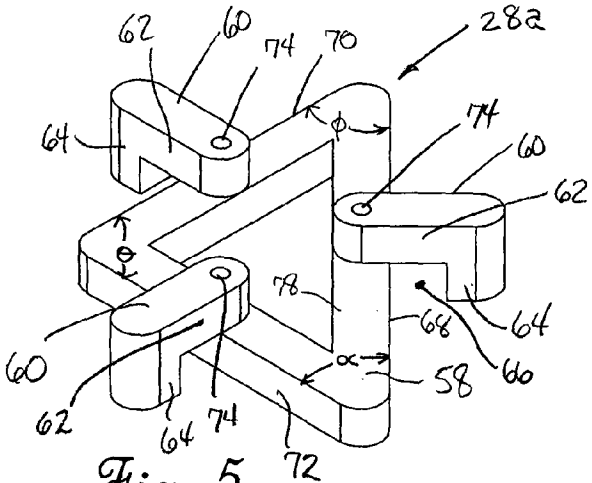
FIG. 5 is an enlarged perspective view of one of the clips shown in FIGS. 1 and 2 which is triangular in shape and has two 45° angles and a 90° angle.
Figure 8:
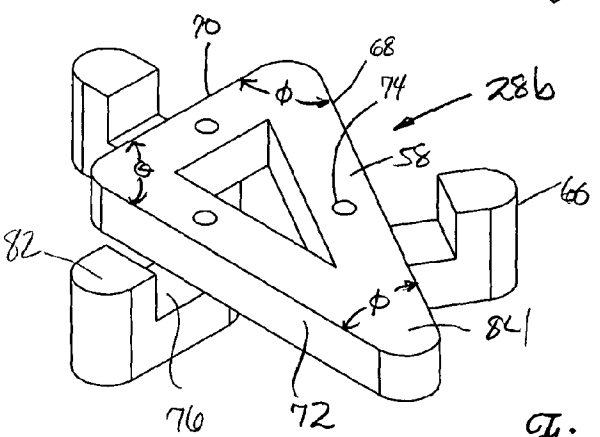
FIG. 8 is an inverted perspective view of the clip of FIG. 7.
Figure 7:
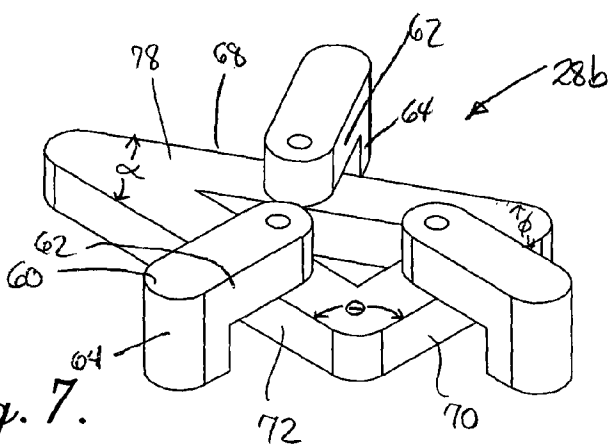
FIG. 7 is an enlarged perspective view of another one of the clips shown in FIGS. 1 and 2 which is also triangular in shape and has a 30° angle, a 60° degree angle and a 90° angle.

The clips 28 are configured to attaching to the model structural members 22 and holding them in position during bonding of model structural members 22 to one another during construction of the model structures 30. Each of the clips 28 includes a frame 58 and at least one arm 60 connected to the frame 58. The arm 60 is resilient and yieldable and includes an shoulder 62 which extends outwardly from the frame 58 and a finger 64 separated from the frame 58 by a space 66 corresponding to the thickness of the model structural members with which it is used. Preferably, the frame 58 includes a plurality of edges 68, 70 and 72, each of the edges having a corresponding one of the arms 60 located substantially midway along the corresponding edge between angles between the edges, as shown in FIGS. 5, 6, 7 and 8. A hole 74 extends through the arm 60 and the frame 58, the hole being sized to receive a conventional sewing pin therethrough. While the frames 58 may be of a variety of different configurations and the edges may be straight or arcuate, it is advantageous for the edges to be straight and positioned at predetermined angles to one another. Thus, triangular-shaped frames 58 are beneficial for fitting into corners where the structural members 22 are to be joined, with three predetermined angles $\alpha$, $\phi$ and $\theta$ being located at the corners of the frame 58 whereby the clips 28 are very useful in maintaining alignment of the model structural members 22 at desired predetermined angles. Clip **28*a* is shown in FIGS. 5 and 6 and illustrates the use of a frame 58 having three edges 68, 70 and 72 where the angles $\alpha$ and $\phi$ are each 45° and the angle $\theta$ is 90°, while FIGS. 7 and 8 illustrate a clip 28*b* having a frame 58 having three edges 68, 70 and 72 where the angle $\alpha$ is 30°, the angle $\phi$ is 60° and the angle $\theta$ is 90°. The arms 60 are preferably fixed to the frame 58 but yieldable whereby the finger 64 may snap over the model structural member 22 and hold it tightly against the edge corresponding to the finger. Because the bottom surface 76 of the shoulder 64 aligns with a top surface 78 of the frame 58, the arms 60 also help to align and maintain at least one margin of the model structural members 22 clipped thereto in substantially the same plane during construction. The clips 28 may be provided of a different materials depending on the type of bonding to be performed, but most advantageously are unitarily molded of synthetic resin such as polyethylene. The clips 28, like the retainers 26, may be molded of different colors as an aid to identification, e.g. clip 28***a* could be molded of one color and clip 28*b* could be molded of a different color. Furthermore, the clips 28 may be molded of different sizes and in a variety of shapes, such as rectangular, pentagonal, etc., and further can be molded 58 in three dimensions for holding model structural members 22 extending in three different orthogonal axes, or with one or more edges being arcuate, or having two or more arms on an edge. The arms 60 preferably extend perpendicular to the adjacent edge, while the bottom 82 of the fingers 64 is preferably both flat and coplanar with a bottom surface 84 of the frame 58.

In use, the user preferably, at least initially, slides the base member 24 into the carrier 38 and may, if desired, temporarily affix it thereto using adhesive tape or the like to resist sliding. After the model structural members 22 are cut from strips or rods of the starting material, they may initially be laid out on the base member and aligned using the recesses 36 as a visual guide. For example, when the starting material is strips of balsa or basswood, the user cuts them to desired lengths and can arrange them on the base member using the recesses for initial alignment purposes. One or more of the model structural members 22 can be placed on the base member 24 and aligned using the recesses 36 as a measuring and alignment guide. Adhesive such as glue may be applied where two or more model structural members 22 touch one another. One or more retainers 26 are then used to hold the model structural members 22 in their desired position, with their respective pegs placed in the desired recesses 36 and the flange 48 holding the model structural member 22 down. The engagement surface 54 of the lobe 50 is brought into abutment with the model structural members 22 held by the flange 48 by turning the handle. Because the engagement surface 54 is eccentrically positioned relative to the peg 46, turning the handle 52 causes the retainer 26 to pivot around the peg 46 and moves the engagement surface 54 toward or away from the adjacent model structural member 22. Thus, the model structural member 22, once engaged by the engagement surface 54, can be pushed along the top surface of the base member 24 and into contact with another model structural member 22. By using an appropriate recess 36 and the eccentricity of the engagement surface 54, a biasing force can be applied to the model structural member 22 to ensure good adhesion at a joint where adhesive is applied and maintained by the friction fit while the adhesive bond is cured. In addition, as shown in FIG. 10, the retainers 26 may be used to impart a curve to a model structural member and maintain the curved configuration. For example, when balsa or basswood is used as the material for the model structural member, soaking the wood model structural member 22 in water permits greater flexibility and tempers the brittleness of the material. By desired positioning of the retainers 26 in selected recesses 36, the model structural member may be bent into a curve and held in place until it dries. Other models structural members may be bonded to the curved piece to assemble, for example, a model arch bridge.

The user may also employ the clips 28 to hold the connected model structural members 22 in alignment during curing of the bond. By laying the model structural edges along an edge of the clip 28, a desired, predetermined angular relationship between two connected model structural members can be maintained. The user then snaps the arm 60 of the clip over a desired model structural member 22, which then is aligned along the edge of the frame 58 of the clip 28. As shown in FIG. 2, combinations of differently configured clips 28, such as clips 28*a* and 28*b* may be used to align the model structural members at the desired angles $\alpha$, $\phi$ or $\theta$ by using the arms to attach two or more model structural members to the clip 28. As may be seen in FIG. 2, by using two different clips 28*a* and 28*b*, the model structure may be assembled with substantial consistency of different angles of 30°, 45°, 60° and 90°. This is beneficial in educational environments where after testing, the students may compare the results of different angular connections to see which angles provided greater strength. By using the alignment ability of the base member 22 in combination with the retainers 26 and clips 28, the angles and lengths between the model structural members in the design can be more easily replicated and carried over to the assembled construction, with the retainers 26 further providing a biasing force to clamp the model structural members 22 together for good adhesion during curing of the bonds.

The apparatus 20 hereof is also useful after the model structural members 22 have been assembled into essentially planar components 80 as shown in FIGS. 1 and 2. Once the components 80 have been assembled and bonded such as by adhesive, the components 80 may be shifted into an upright orientation on the base member 24. For example as shown in FIG. 10, two components 80 are held by retainers onto the base member 24. Some or all of the clips 28 may remain with the components to provide additional strength and stability during handling and further assembly, as illustrated. In addition, additional model structural members 22 are used to connect the components 80 and complete the model structure 30. In the case of the bridge 32 shown in FIG. 10, clips 28 are used to hold some of the model structural members 22 to the components 80 during final assembly, it being noted that the clips 28 are positioned well above the board and fastened to the model structural members 22. In order to permit another user to use the carrier 38, the base member 28 may be removed from the carrier 38 for curing of the bond, with the retainers 26 still holding the model structure 30 to the base member 24. Then, a new base member 24 may be inserted into the carrier 38 to permit another user to begin the process on a new model structure. After final curing of the bond, the retainers 26 and clips 28 may be removed and the model structure 30 moved from the base member 24, and any adhesive is then cleaned from the base member 24 to permit reuse.

As noted previously, it may be desired to use materials other than wood model structural members 22. If, for example, it is desired to use metal rods for the material of the model structural members and soldering, brazing or welding to bond the metal rods to one another, a heat resistant material such as brass, steel or the like should be used for the base member and preferably for any retainers or clips used in close proximity to the bonding site.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. An apparatus for retaining model structural members in position during construction of a model structure, comprising:

a base member having a plurality of recesses therein; and at least one one-piece retainer having an integrally connected peg, flange, lobe and handle, said peg having a first transverse dimension complementally sized with said recesses for removable receipt therein, said flange having a second transverse dimension greater than the first transverse dimension and sized for holding a model structural member between the base member and the flange, said lobe positioned between the flange and the peg, said lobe having a greater cross-sectional area than the peg to resist entry into a recess of the base member and having a transverse dimension which is smaller than the second transverse dimension of the flange whereby a model structural member may be held between the flange and the base member by the retainer, and said handle extending from the flange opposite said peg, wherein said peg is sized and configured for pivoting within said recesses and for frictional engagement with the base member surrounding said recesses, said retainer being formed as a unitary member whereby turning of the handle causes the retainer to pivot about the peg as a whole when the peg is received within one of said recesses and the frictional engagement with the base member resists such pivoting when the handle is not turned;

said apparatus further including at least one model structural member having a thickness, said engagement surface of said lobe having a height between the flange and the peg substantially corresponding to the thickness of the model structural member.

2. An apparatus as set forth in claim 1, wherein the base member is substantially planar.

3. An apparatus as set forth in claim 1, wherein the recesses are holes extending through the base member.

4. An apparatus as set forth in claim 1, including a multiplicity of said recesses arranged in a plurality of rows and columns.

5. An apparatus as set forth in claim 4, wherein the spacing between adjacent recesses in said rows and in said columns is substantially constant.

6. An apparatus as set forth in claim 1, wherein said base member is constructed of a synthetic resin material.

7. An apparatus as set forth in claim 1, including a carrier removably mounting said base member thereon.

8. An apparatus as set forth in claim 7, wherein said carrier includes a pair of side rails, said base member being sized for slidable receipt between said side rails.

9. An apparatus as set forth in claim 1, wherein said lobe includes a circumscribing engagement surface positioned intermediate said peg and said flange.

10. An apparatus as set forth in claim 9, wherein said engagement surface is eccentrically positioned relative to said peg.

11. An apparatus as set forth in claim 10, wherein said lobe is substantially circular having a center axis, and wherein said peg is circular in cross section and has a pivot axis spaced from said center axis.

12. An apparatus as set forth in claim 1, further including a clip having a frame including a plurality of edges oriented at least at two acute angles and including an arm on the frame sized for holding the model structural member against at least one of the edges.

13. An apparatus for retaining model structural members in position during construction of a model structure, comprising:

a base member having a plurality of recesses therein;

at least one retainer having a peg having a first transverse dimension complementally sized with said recesses for removable receipt therein and a flange having a second transverse dimension greater than the first transverse dimension and sized for holding a model structural member between the base member and the flange; and a clip having a frame including a plurality of edges and including an arm on the frame sized for holding a model structural member against the edge, wherein said arm includes a shoulder extending outwardly from said frame and a finger spaced from one of said edges for receiving and holding a model structural member in a space located between the said one of said edges and said finger.

14. An apparatus as set forth in claim 13, wherein said frame is substantially triangular in configuration.

15. An apparatus as set forth in claim 14, including a plurality of said clips, at least one of said plurality of clips having a first triangular configuration and at least another of said plurality of clips having a second triangular configuration different from said first triangular configuration.

16. A method of retaining model structural members during construction of a model structure, said method comprising the steps of:

providing a base member having a plurality of recesses therein, at least one retainer having a peg of a first transverse dimension complementally sized for receipt in said recesses, a flange having a second transverse dimension substantially greater than said first transverse dimension, a lobe positioned between the flange and, the peg, said lobe having a greater cross-sectional area than the peg to resist entry into a recess of the base member and having a transverse dimension which is smaller than the second transverse dimension of the flange, and a handle extending from the flange opposite said peg, said retainer being formed as a unitary member whereby turning of the handle causes the retainer to pivot about the peg when the peg is received within one of said recesses, and a plurality of model structural members;

holding a first of said plurality of model structural members in contact with said base member using said at least one retainer by inserting said peg of said at least one retainer into a recess proximate said model structural member with at least a portion of said model structural member held by said flange against said base member; and bonding a second one of said plurality of model structural members to said first of said plurality of model structural members; and curing the bond between the first and second structural members.

17. A method as set forth in claim 16, wherein said bonding is provided by adhesive.

18. A method as set forth in claim 16, including providing a clip having a frame including at least a first edge and a second edge and an arm extending from said frame and oriented for holding a model structural member against at least one of said edges, and including the step of attaching said clip to one of the first and second model structural members with one of the first and second model structural members aligned along the first edge and the other of the first and second model structural members aligned along the second edge.

19. A method as set forth in claim 18, including providing a second clip having a frame including at least a first edge and a second edge and an arm extending from said frame and oriented for holding a model structural member against at least one of said edges, and providing a third model structural member, and including the step of attaching said second clip to one of the first, second and third model structural members with two of the first, second and third model structural members aligned along respective first and second edges of said second clip.

20. A method as set forth in claim 16, including providing at least three of said retainers and wherein the first model structural member is flexible, and including the steps of bending said first model structural member into a curve and positioning said retainers on alternate first and second sides of said first model structural member with the pegs of said retainers received in different recesses for retaining the first model structural member between said base member and said retainers in a bent configuration, wherein said bonding and curing steps are carried out after the bending step.

21. A method as set forth in claim 16, wherein said retainer lobe has a circumscribing engagement surface located between said flange and said peg, said engagement surface being eccentrically positioned relative to said peg, and including the step of turning said handle to thereby pivot said retainer with said peg in said one of said recesses for moving said engagement surface against said first model structural member.

22. A one-piece retainer for holding model structural members to a member having a recess therein, said retainer having an integrally connected peg, flange, lobe and handle, said peg having a first transverse dimension, said flange having a second transverse dimension larger than said first transverse dimension, said handle extending from said flange opposite from said peg, and said lobe positioned intermediate said peg and said flange and having a third transverse dimension greater than said first transverse dimension and less than said second transverse dimension, said lobe including a circumscribing engagement surface which is positioned in eccentric relationship to said peg, wherein said retainer is molded of synthetic resin and of a unitary construction.

23. A retainer as set forth in claim 22, wherein said lobe has a substantially circular engagement surface defining a center of the lobe and wherein said peg is offset relative to the center of the lobe.

* * * * *